US007938659B1

(12) United States Patent
Zhu et al.

(10) Patent No.: US 7,938,659 B1
(45) Date of Patent: May 10, 2011

(54) COMPOUND CONNECTOR PLUG

(75) Inventors: Yong-feng Zhu, Shenzhen (CN); Qing-liang Li, Shenzhen (CN); You-wen Liu, Shenzhen (CN)

(73) Assignee: Shenzhen Oversea Win Technology Co., Ltd., Shenzhen City (CN)

( * ) Notice: Subject to any disclaimer, the term of this patent is extended or adjusted under 35 U.S.C. 154(b) by 0 days.

(21) Appl. No.: 12/825,440

(22) Filed: Jun. 29, 2010

(51) Int. Cl.
*H01R 27/00* (2006.01)

(52) U.S. Cl. ..... 439/218; 439/660

(58) Field of Classification Search ..... 439/217, 439/218, 660, 76.1, 79
See application file for complete search history.

(56) References Cited

U.S. PATENT DOCUMENTS 7,090,509 B1 * 8/2006 Gilliland et al. ..... 439/76.1
7,534,143 B1 * 5/2009 Tsao et al. ..... 439/607.41
7,699,663 B1 * 4/2010 Little et al. ..... 439/660
7,806,704 B2 * 10/2010 Miyoshi et al. ..... 439/108

* cited by examiner

*Primary Examiner* — Khiem Nguyen
(74) *Attorney, Agent, or Firm* — Bacon & Thomas, PLLC

(57) ABSTRACT

A compound connector plug is disclosed in the present invention. It has a first fixing device for fixing a first terminal set and a second terminal set, and a second fixing device for fixing a third terminal set. The first terminal set has an improved shape so that the compound connector plug can be easily produced. The two devices are connected together and enclosed by a casing. Each terminal set or the combination of terminal sets can support transmission standards, such as eSATA, USB2.0 and USB3.0. An all-in-one connector plug is provided so that no adaptor is needed if a user uses the connector for different kinds of sockets.

12 Claims, 5 Drawing Sheets

COMPOUND CONNECTOR PLUG

FIELD OF THE INVENTION

The invention relates to a compound connector plug, and more particularly, to a compound connector plug compatible with both Universal Serial Bus (USB 2.0 and USB 3.0) standards and External Serial Advanced Technology Attachment (eSATA) standards.

BACKGROUND OF THE INVENTION

The remarkable development of computer equipments has been seen as technology evolved over the years. It is always the target for all manufacturers to create devices for faster and more efficient data transmission. However, replacement of an existing standard with a new one involves not only the industrial technique, but also user who uses related products. The latter dominates since all users tend to keep using current products until they are not workable anymore.

Demands of the market for more compact electronic products are growing. In addition to reducing size of each internal element inside a device, external sockets or plugs need to be unified or modified. Otherwise, only necessary sockets and plugs are adopted to be used in the limited external area of the device. Inevitably, there is a gap existing between reality and expectation. For many peripheral or connected electronic products, how to solve the problem of incompatibility due to diverse connectors becomes a primary issue. Therefore, a compound connector plug compatible with multiple standards is required to solve the afore-mentioned problems. Meanwhile, application of such compound connector plugs can significantly reduce the space occupied.

External Serial Advanced Technology Attachment (eSATA) and Universal Serial Bus (USB) are two kinds of commonly used standards for connectors. Because the size of connector of the eSATA standard is similar to that of the USB standard, the two connectors can be devised to share one compound connector plug. FIG. 1 discloses a compound connector plug of Taiwanese Utility Model M369570. The invention comprises a housing with a slot. A first terminal set having a number of eSATA terminals and a second terminal set having a plurality of USB terminals are installed in the slot. The first and the second terminal sets are compatible with eSATA standards and USB 3.0 standards, respectively.

In mass production, the connector plug of the above prior art is inserted to USB terminals by ways of Insert Molding, and the hook tip 1 will be snagged with plastic injection hole 2 for USB 3.0, which will cause defective products and slow production. Therefore, the inventor creates a connector plug compatible with both eSATA and USB 3.0 standards based on the demands of related industrials.

SUMMARY OF THE INVENTION

The present invention provides a compound connector plug, including: a first terminal set, having a plurality of first terminals each having a first contact in the shape of V for electrically connecting to a corresponding terminal in a first external connector socket by a bottom of the first contact in the shape of V; a first bonding end for connecting with an electric signal delivering device; and a first linking portion between the first contact and the first bonding end; a second terminal set, having a plurality of second terminals each having a second contact for electrically connecting to a corresponding terminal in a second external connector socket; a second bonding end for connecting with the electric signal delivering device, and a second linking portion between the second contact and the second bonding end; a first fixing device, having a plurality of first trenches connected with the first linking portions for fixing the first terminals; and a plurality of second trenches under the first trenches connected with the second linking portions for fixing the second terminals; a third terminal set having a plurality of third terminals each including a third contact for electrically connecting to a corresponding terminal in a third external connector socket; a third bonding end for connecting with the electric signal delivering device; and a third linking portion between the third contact and the third bonding end; a second fixing device, having a plurality of third trenches connected with the third linking portions for fixing the third terminals; a housing, for holding the fixing devices, protecting each terminal and defining shape of the plug; and a bonding end fixing device, for fixing each bonding end, wherein the first fixing device is installed on the second fixing device.

The present invention further introduces another compound connector plug encompassing: a first terminal set, including a plurality of first terminals each has a first contact in the shape of open-ended triangle having an obtuse angle for electrically connecting to a corresponding terminal in a first external connector socket across the obtuse angle; a first bonding end for connecting with an electric signal delivering device; and a first linking portion between the first contact and the first bonding end; a second terminal set, including a plurality of second terminals each comprising a second contact for electrically connecting to a corresponding terminal in a second external connector socket; a second bonding end for connecting with the electric signal delivering device, and a second linking portion between the second contact and the second bonding end; a first fixing device, having a plurality of first trenches connected with the first linking portions for fixing the first terminals; a plate at the end of the plurality of the first trenches for aligning connection of the first contact; and a plurality of second trenches under the first trenches connected with the second linking portions for fixing the second terminals; a third terminal set, having a plurality of third terminals each comprising a third contact for electrically connecting to a corresponding terminal in a third external connector socket; a third bonding end for connecting with the electric signal delivering device; and a third linking portion between the third contact and the third bonding end; a second fixing device, having a plurality of third trenches connected with the third linking portions for fixing the third terminals; a housing, for holding the fixing devices, protecting each terminal and defining shape of the plug; and a bonding end fixing device, for fixing each bonding end, wherein the first fixing device is installed on the second fixing device.

Preferably, the first terminal set is compatible with eSATA (External Serial Advanced Technology Attachment) standards.

Preferably, the third terminal set is compatible with USB (Universal Serial Bus) 2.0 standards.

Preferably, combination of the second terminal set and the third terminal set is compatible with USB 3.0 standards.

Preferably, the second terminal set has 5 second terminals and the third terminal set has 4 third terminals.

Preferably, the electric signal delivering device is a circuit board or wire.

DETAILED DESCRIPTION OF THE PREFERRED EMBODIMENTS

The present invention will be described more precisely in the following two embodiments.

Figure 2:
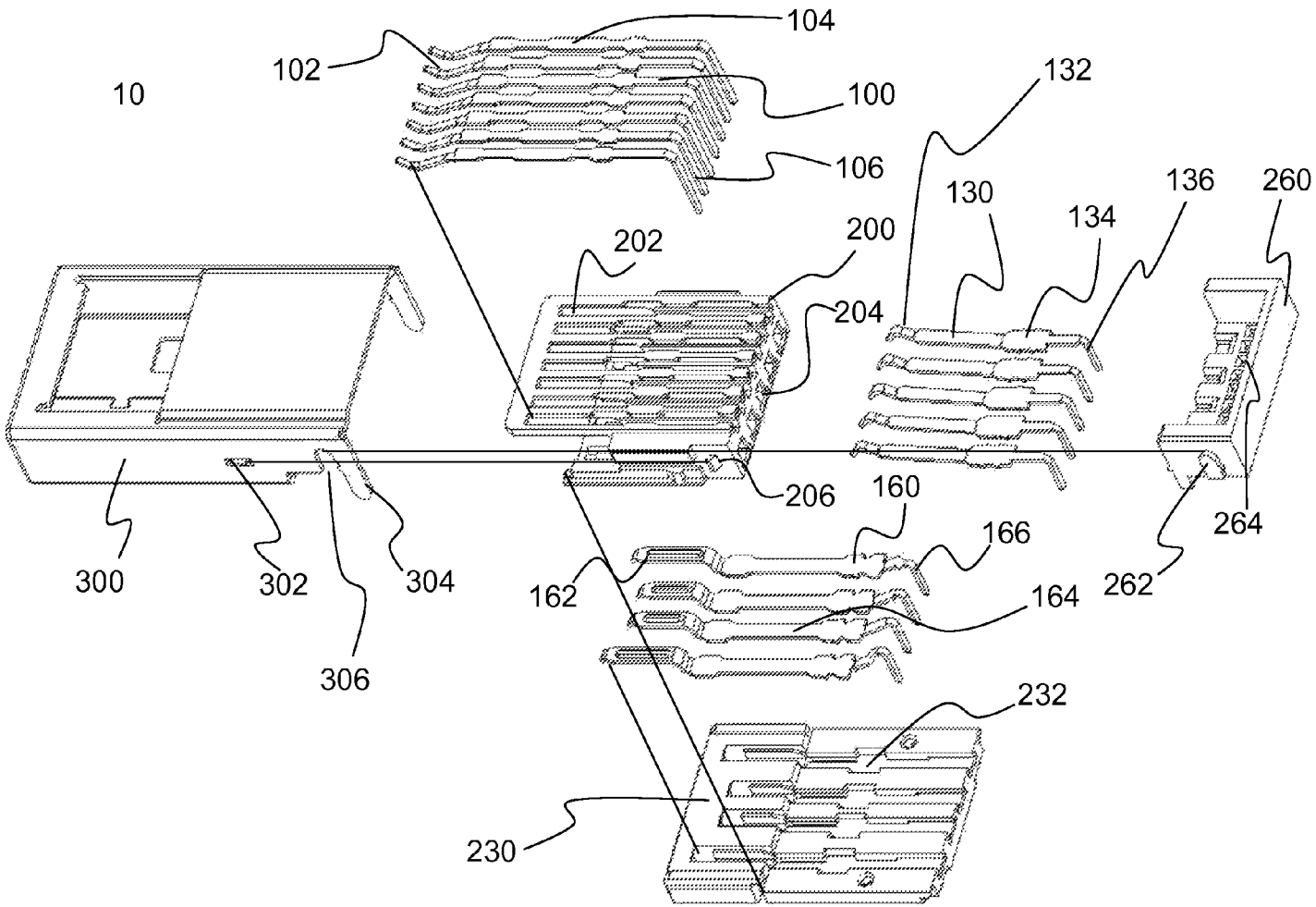
FIG. 2 illustrates an exploded view of a first embodiment according to the present invention.
Figure 3:
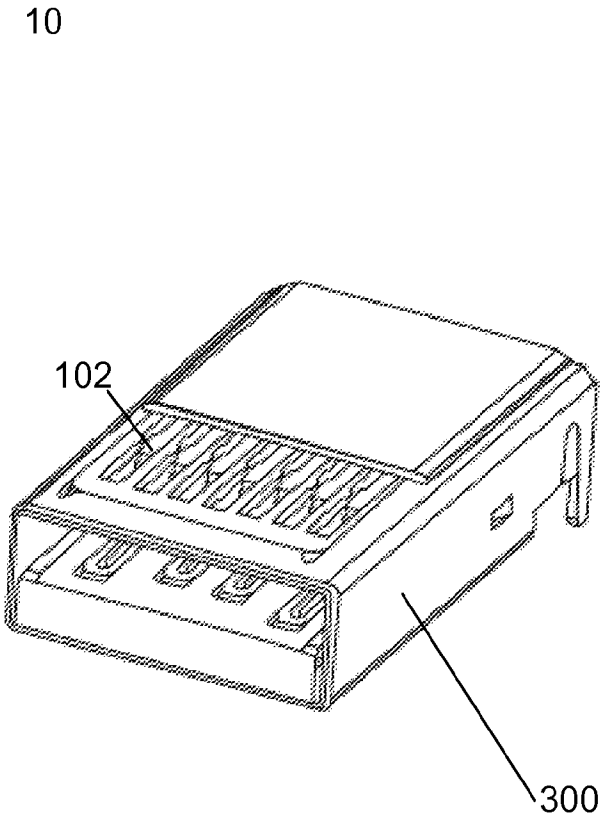
FIG. 3 illustrates a schematic view of the first embodiment according to the present invention.

Please refer to FIG. 2 and FIG. 3. FIG. 2 is an exploded view of a first embodiment. FIG. 3 is a schematic view of the first embodiment. A connector plug 10 includes seven first terminals 100, five second terminals 130, four third terminals 160, a first fixing device 200, a second fixing device 230, a bonding end fixing device 260 and a housing 300. Combination of the first terminals 100 forms a first terminal set. Combination of the second terminals 130 forms a second terminal set. Combination of the third terminals 160 forms a third terminal set.

The first terminal 100 has a first contact 102 in the shape of V for electrically connecting with a corresponding terminal in a first external connector socket (not shown) by a bottom of the first contact 102 in the shape of V, a first bonding end 106 for connecting with a wire, and a first linking portion 104 between the first contact 102 and the first bonding end 106 for providing a proper shape to fix the first terminal 100. The second terminal 130 has a second contact 132 for electrically connecting with a corresponding terminal in a second external connector socket (not shown), a second bonding end 136 for connecting with a wire, and a second linking portion 134 between the second contact 132 and the second bonding end 136 for providing a proper shape to fix the second terminal 130. The third terminal 160 has a third contact 162 for electrically connecting with a corresponding terminal in a third external connector socket (not shown), a third bonding end 166 for connecting with a wire, and a third linking portion 164 between the third contact 162 and the third bonding end 166 for providing a proper shape to fix the third terminal 160.

The first fixing device 200 includes seven first trenches 202, having several horizontally extended fixing elements thereon, for engaging with the first linking portions 104 to fix the first terminals 100, five second trenches 204 below the first trenches 202, having a number of horizontally extended fixing elements thereon, for engaging with the second linking portions 134 to fix the second terminals 130, and two positioning hooks 206 for connecting with the housing 300 and positioning.

The second fixing device 230 encompasses four third trenches 232 having several horizontally extended fixing elements thereon for engaging with the third linking portions 164 to fix the third terminals 160.

The first fixing device 200 can be installed on the second fixing device 230 in order to position each terminal. The housing 300 has two positioning hooks 302 to engage with the positioning hooks 206 of the first fixing device 200.

Figure 1:
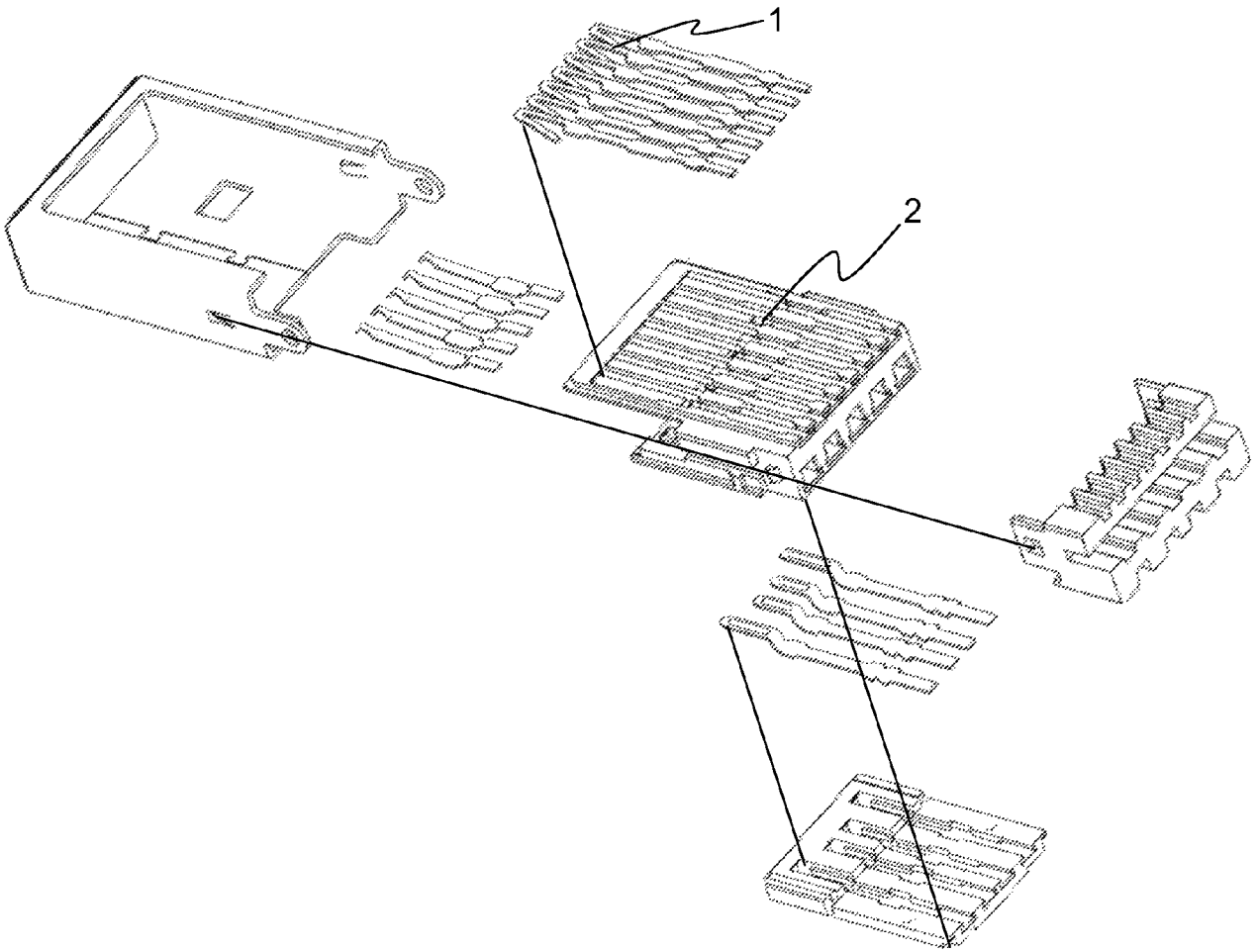
Fig. 1 (Prior Art)
FIG. 1 illustrates a compound connector plug according to the prior art.

The bonding end fixing device 260 has a number of guiding trenches 264 for holding the bonding ends. Besides, two tenons 262 bonded with two slots of the housing 300 are included to fix the bonding end fixing device 260 and the housing 300, as shown in FIG. 3. The first contact 102 in the shape of V is fixed to the first trenches 202. By its V-shaped bottom, the first contact 202 electrically connects with a corresponding terminal in a first external connector socket (not shown), to avoid the situation in which the hook tip 1 of the prior art in FIG. 1 is snagged with plastic injection hole 2 for USB 3.0, which will cause products defective and adversely influence yield thereof.

In addition, the housing 300 has two connecting holders 304 to fix the connector plug on a circuit board. The housing 300 is also used to hold the fixing devices and protect each terminal and define shape of the plug.

In this embodiment, the first external connector socket (not shown) is an eSATA connector socket, the second external connector socket (not shown) is an USB 3.0 connector socket, and the third external connector socket (not shown) is an USB 2.0 connector socket. The first terminal set is compatible with eSATA standards, the third terminal set is compatible with USB 2.0 standards, and the combination of the second terminal set and the third terminal set is compatible with USB 3.0 standards. Therefore, the second terminal set has five second terminals 130 and third terminal set has four third terminals 160.

Figure 4:
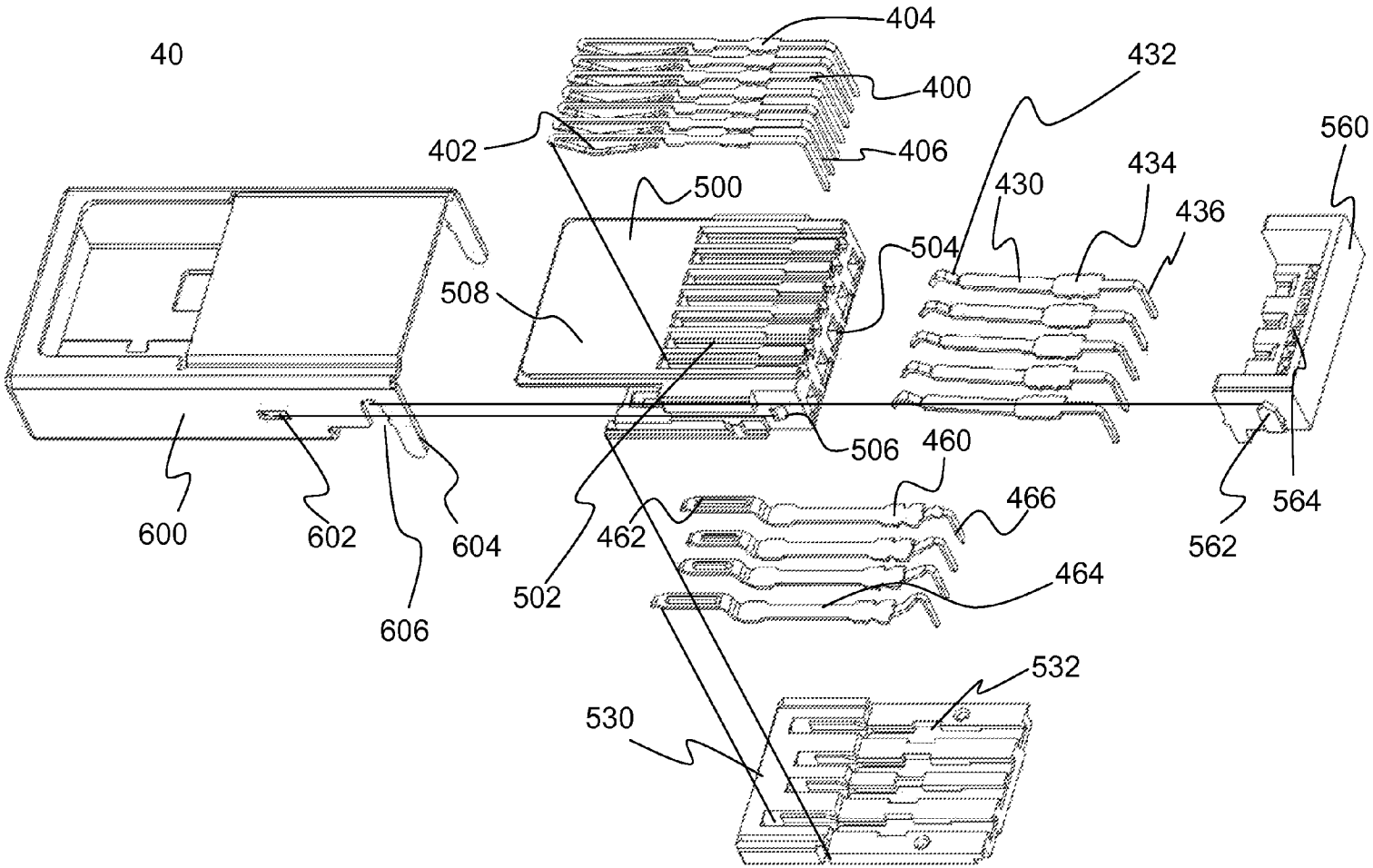
FIG. 4 illustrates an exploded view of the second embodiment according to the present invention.
Figure 5:
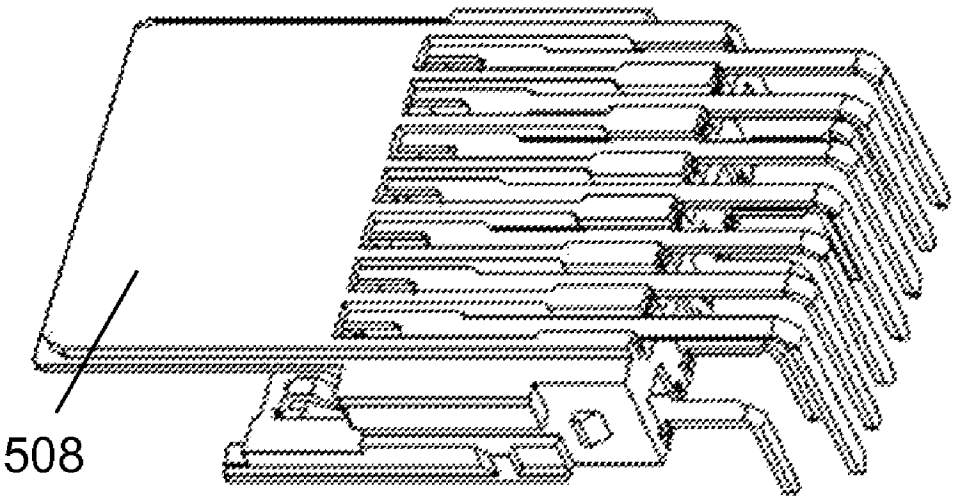
FIG. 5 illustrates an assembly view of the second embodiment according to the present invention.

Please refer to FIG. 4 and FIG. 5. FIG. 4 is an exploded view of a second embodiment. FIG. 5 is an assembly view for each part. A connector plug 40 includes seven first terminals 400, five second terminals 430, four third terminals 460, a first fixing device 500, a second fixing device 530, a bonding end fixing device 560 and a housing 600. Combination of the first terminals 400 forms a first terminal set. Combination of the second terminals 430 forms a second terminal set. Combination of the third terminals 460 forms a third terminal set.

The first terminal 400 has a first contact 402 in the shape of open-ended triangle having an obtuse angle for electrically connecting with a corresponding terminal in a first external connector socket (not shown), a first bonding end 406 for connecting with a wire, and a first linking portion 404 between the first contact 402 and the first bonding end 406 for providing a proper shape to fix the first terminal 400. The second terminal 430 has a second contact 432 for electrically connecting with a corresponding terminal in a second external connector socket (not shown), a second bonding end 436 for connecting with a wire, and a second linking portion 434 between the second contact 432 and the second bonding end 436 for providing a proper shape to fix the second terminal 430. The third terminal 460 has a third contact 462 for electrically connecting with a corresponding terminal in a third external connector socket (not shown), a third bonding end 466 for connecting with a wire, and a third linking portion 464 between the third contact 462 and the third bonding end 466 for providing a proper shape to fix the third terminal 460.

The first fixing device 500 includes seven first trenches 502 having several horizontally extended fixing elements thereon for holding the first linking portions 404 to fix the first terminals 400, five second trenches 504 under the first trenches 502 having a number of horizontally extended fixing elements thereon, for holding the second linking portions 434 to fix the second terminals 430, two positioning hooks 506 for connecting with the housing 600 and positioning, and a plate 508 at the end of the first trenches 502, for aligning connection of the first contact 402, which allows the first trenches 402 to extend to inserting holes (not shown) of the plate 508 without snagging with plastic injection hole for USB 3.0. Moreover, design of the plate 508 also allows the first trenches 502 of first fixing device 500 to be modified from hollow-cut to close-ended. The engagement of the plate 508 and the first contact 402 is shown in FIG. 5.

The second fixing device 530 includes four third trenches 532, having several horizontally extended fixing elements thereon, for holding the third linking portions 464 to fix the third terminals 460.

The first fixing device 500 can be installed on the second fixing device 530 in order to position each terminal. The fixing devices 500 and 530 are bonded first to assemble with the housing 600, and then connected with the bonding end fixing device 560. The housing 600 has two positioning hooks 602 to engage with the positioning hooks 506 of the first fixing device 500.

The bonding end fixing device 560 comprises a number of guiding trenches 564 for fixing each bonding end. In addition, it has two tenons 562, connected with two slots 606 on the housing 600, for fixing the bonding end fixing device 560 and the housing 600. The housing 600 has two connecting holders 604 for fixing the connector plug 40 on a circuit board. The housing 600 is also used to fix each fixing device, protect each terminal and define shape of the plug.

In the present embodiment, the first external connector socket (not shown) is an eSATA connector socket, the second external connector socket (not shown) is an USB 3.0 connector socket, and the third external connector socket (not shown) is an USB 2.0 connector socket. The first terminal set is compatible with eSATA standards, the third terminal set is compatible with USB 2.0 standards and the combination of the second terminal set and the third terminal set is compatible with USB 3.0 standards. Therefore, the second terminal set has five second terminals 430 and the third terminal set has four third terminals 460.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A compound connector plug, comprising:

a first terminal set, having a plurality of first terminals each comprising a first contact in the shape of V for electrically connecting to a corresponding terminal in a first external connector socket by a bottom of the first contact in the shape of V, a first bonding end for connecting with an electric signal delivering device, and a first linking portion between the first contact and the first bonding end;

a second terminal set, having a plurality of second terminals each comprising a second contact for electrically connecting to a corresponding terminal in a second external connector socket, a second bonding end for connecting with the electric signal delivering device, and a second linking portion between the second contact and the second bonding end;

a first fixing device, having a plurality of first trenches connected with the first linking portions for fixing the first terminals, and a plurality of second trenches under the first trenches connected with the second linking portions for fixing the second terminals;

a third terminal set, having a plurality of third terminals each comprising a third contact for electrically connecting to a corresponding terminal in a third external connector socket, a third bonding end for connecting with the electric signal delivering device, and a third linking portion between the third contact and the third bonding end;

a second fixing device, having a plurality of third trenches connected with the third linking portions for fixing the third terminals;

a housing, for holding the fixing devices, protecting each terminal and defining shape of the plug; and a bonding end fixing device, for fixing each bonding end, wherein the first fixing device is installed on the second fixing device.

2. The connector plug according to claim 1, wherein the first terminal set is compatible with eSATA (External Serial Advanced Technology Attachment) standards.

3. The connector plug according to claim 1, wherein the third terminal set is compatible with USB (Universal Serial Bus) 2.0 standards.

4. The connector plug according to claim 1, wherein combination of the second terminal set and the third terminal set is compatible with USB 3.0 standards.

5. The connector plug according to claim 1, wherein the second terminal set has 5 second terminals and the third terminal set has 4 third terminals.

6. The connector plug according to claim 1, wherein the electric signal delivering device is a circuit board or wire.

7. A compound connector plug, comprising:

a first terminal set, including a plurality of first terminals each comprising a first contact in the shape of open-ended triangle having an obtuse angle for electrically connecting to a corresponding terminal in a first external connector socket across the obtuse angle, a first bonding end for connecting with an electric signal delivering device, and a first linking portion between the first contact and the first bonding end;

a second terminal set, including a plurality of second terminals each comprising a second contact for electrically connecting to a corresponding terminal in a second external connector socket, a second bonding end for connecting with the electric signal delivering device, and a second linking portion between the second contact and the second bonding end;

a first fixing device, having a plurality of first trenches connected with the first linking portions for fixing the first terminals, a plate at the end of the plurality of the first trenches for aligning connection of the first contact, and a plurality of second trenches under the first trenches connected with the second linking portions for fixing the second terminals;

a third terminal set, having a plurality of third terminals each comprising a third contact for electrically connecting to a corresponding terminal in a third external connector socket, a third bonding end for connecting with the electric signal delivering device, and a third linking portion between the third contact and the third bonding end;

a second fixing device, having a plurality of third trenches connected with the third linking portions for fixing the third terminals;

a housing, for holding the fixing devices, protecting each terminal and defining shape of the plug; and a bonding end fixing device, for fixing each bonding end, wherein the first fixing device is installed on the second fixing device.

8. The connector plug according to claim 7, wherein the first terminal set is compatible with eSATA (External Serial Advanced Technology Attachment) standards.

9. The connector plug according to claim 7, wherein the third terminal set is compatible with USB (Universal Serial Bus) 2.0 standards.

10. The connector plug according to claim 7, wherein combination of the second terminal set and the third terminal set is compatible with USB 3.0 standards.

11. The connector plug according to claim 7, wherein the second terminal set has 5 second terminals and the third terminal set has 4 third terminals.

12. The connector plug according to claim 7, wherein the electric signal delivering device is a circuit board or wire.

* * * * *